US011369190B2

(12) United States Patent
Chang

(10) Patent No.: US 11,369,190 B2
(45) Date of Patent: Jun. 28, 2022

(54) DETANGLING MASSAGE BRUSH

(71) Applicant: Stephanie Chang, Herndon, VA (US)

(72) Inventor: Stephanie Chang, Herndon, VA (US)

(73) Assignees: Stephanie Chang, Herndon, VA (US); LUCKY DRAGON ENTERPRISE GROUP LIMITED, North Point (HK)

( * ) Notice: Subject to any disclaimer, the term of this patent is extended or adjusted under 35 U.S.C. 154(b) by 376 days.

(21) Appl. No.: 16/440,538

(22) Filed: Jun. 13, 2019

(65) Prior Publication Data

US 2020/0154873 A1 May 21, 2020

Related U.S. Application Data

(60) Provisional application No. 62/769,150, filed on Nov. 19, 2018.

(51) Int. Cl.

| | |
|---|---|
| ***A46B 9/00*** | (2006.01) |
| ***A46B 9/02*** | (2006.01) |
| ***A46B 15/00*** | (2006.01) |

(52) U.S. Cl.

CPC ..... *A46B 9/023* (2013.01); *A46B 15/0075* (2013.01); *A46B 2200/102* (2013.01); *A46B 2200/1033* (2013.01)

(58) Field of Classification Search

CPC ..... A46B 9/02; A46B 15/0075; A46B 9/00

See application file for complete search history.

(56) References Cited

U.S. PATENT DOCUMENTS

| | | | | |
|---|---|---|---|---|
| 9,226,570 | B2 * | 1/2016 | Pulfrey | B25G 1/102 |
| 9,706,753 | B2 * | 7/2017 | Moeller et al. | |
| 2015/0135455 | A1 * | 5/2015 | Reusche et al. | |

FOREIGN PATENT DOCUMENTS

| | | | | |
|---|---|---|---|---|
| WO | WO-2011003156 | A1 * | 1/2011 | A46B 9/023 |

* cited by examiner

*Primary Examiner* — Michael D Jennings

(74) *Attorney, Agent, or Firm* — Demian K. Jackson; Jackson IPG PLLC

(57) ABSTRACT

A massage brush includes a bristle base; a plurality of massage bristles formed on the bristle base for massaging scalp; and a plurality of detangling bristles formed on the bristle base for detangling hair. The detangling bristles are thinner than the massage bristles at the bristle base, and having a diameter ranged between 0.4 mm and 1.8 mm. For example, the detangling bristles include a first group of detangling bristles having a diameter ranged between 0.8 mm and 1.8 mm and/or a second group of detangling bristles having a diameter ranged between 0.4 mm and 1 mm.

11 Claims, 17 Drawing Sheets

DETANGLING MASSAGE BRUSH

CROSS-REFERENCE TO RELATED APPLICATIONS

The present application is a nonprovisional application claiming benefit from a prior-filed provisional application bearing a Ser. No. 62/769,150 and filed Nov. 19, 2018, the entity of which is incorporated herein for reference.

FIELD OF THE INVENTION

The present invention relates to a brush, and more particularly to a massage brush having a detangling effect. The present invention also relates to a detangling brush kit including a variety of replaceable accessories for different uses.

BACKGROUND OF THE INVENTION

A massage brush, which is also known as a scalp massage brush or a scalp scrubber, is commonly used for enhancing blood circulation in the scalp and relieving stress, and when used with soap or shampoo, assisting in washing and deep cleaning hair. Since a massage brush directly scrubs scalp, it is desirable that the massage bristles are made of a soft material, and more particular a soft material which is water resistant, e.g. rubber. Moreover, the massage bristles preferably have round tips and/or relatively large tip area to avoid damage of scalp. Unfortunately, when the massage bristles penetrate through hair and conduct circular movements on scalp, tangling likely occurs, and thus might damage hair and hurt scalp.

SUMMARY OF THE INVENTION

Therefore, an object of the present invention is to provide a massage brush, which performs detangling while circularly brushing hair.

Another object of the present invention is to provide a massage brush, which can be differentially operated depending on hair quality.

A further object of the present invention is to provide a massage brush, whose bristles can be easily replaceable to be kept clean and multi-functional.

A still another object of the present invention is to provide a detangling brush kit including replaceable accessories.

An aspect of the present invention relates to a massage brush, which includes a bristle base; a plurality of massage bristles formed on the bristle base for massaging scalp; and a plurality of detangling bristles formed on the bristle base for detangling hair. The detangling bristles are thinner than the massage bristles at the bristle base, and having a diameter ranged between 0.4 mm and 1.8 mm.

Another aspect of the present invention relates to a massage brush, which includes: a bristle base including a massage-functional base and a detangling-functional base; a plurality of massage bristles formed on the massage-functional base for massaging scalp; a plurality of detangling bristles thinner than the massage bristles and formed on the detangling-functional base for detangling hair. The detangling bristles penetrate through holes of the massage-functional base, or the massage bristles penetrate through holes of the detangling-functional base, so that the massage-functional base and the detangling-functional base overlap with each other, and the massage bristles and the detangling bristles stick out of a same surface of the bristle base and are mingled with one another.

A further aspect of the present invention relates to a detangling brush kit, comprising: a brush body; a first functional base formed thereon a plurality of first bristles and a plurality of first holes, and engageable and detachable from the brush body; a second functional base formed thereon a plurality of second bristles and a plurality of second holes, and engageable and detachable from the brush body; and a detangling-functional base formed thereon a plurality of detangling bristles and a plurality of third holes, and engageable and detachable from the brush body. Positions of the third holes are aligned with positions of the first bristles and positions of the second bristles, and the positions of the first holes and positions of the second holes are aligned with positions of the third holes.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

The invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
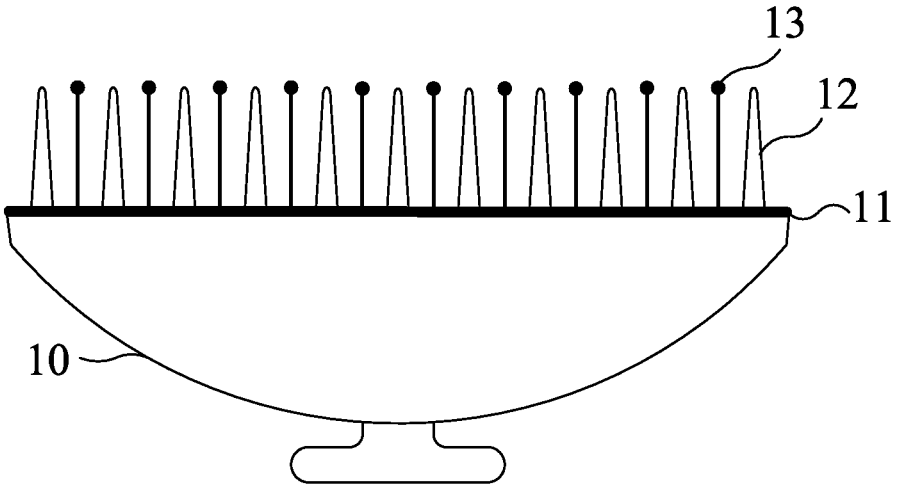
FIGS. 1A-1D are schematic cross-sectional views illustrating examples of appearances of a massage brush according to an embodiment of the present invention.

Please refer to FIG. 1A, in which a massage brush according to an embodiment of the present invention is schematically illustrated. The massage brush includes a supporting base 11 integrated with massage bristles 12 and detangling bristles 13. The massage bristles 12 and detangling bristles 13 stick out of the same face of the supporting base 11 so that the massage bristles 12 and detangling bristles 13 are mixed as hybrid bristles that are capable of detangling hair while massaging scalp. The hybrid bristles consisting of the massage bristles 12 and detangling bristles 13 may be injection-molded or formed in alternative ways onto the supporting base 11, and the supporting base is secured onto a brush body 10 to be held with a user's hand.

Figure 1B:
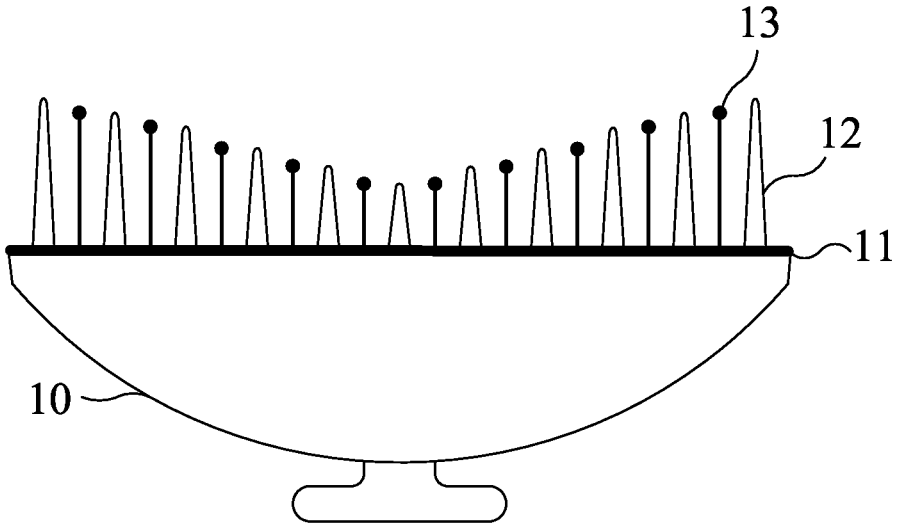
Figure 1C:
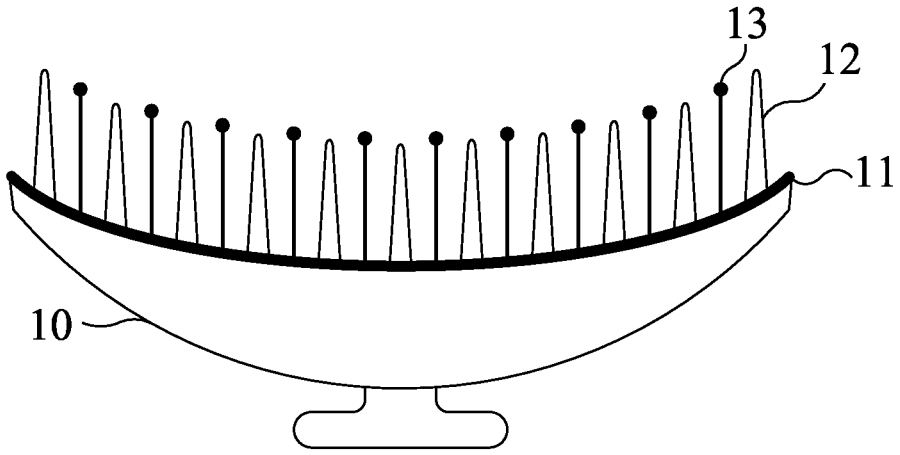
Figure 1D:
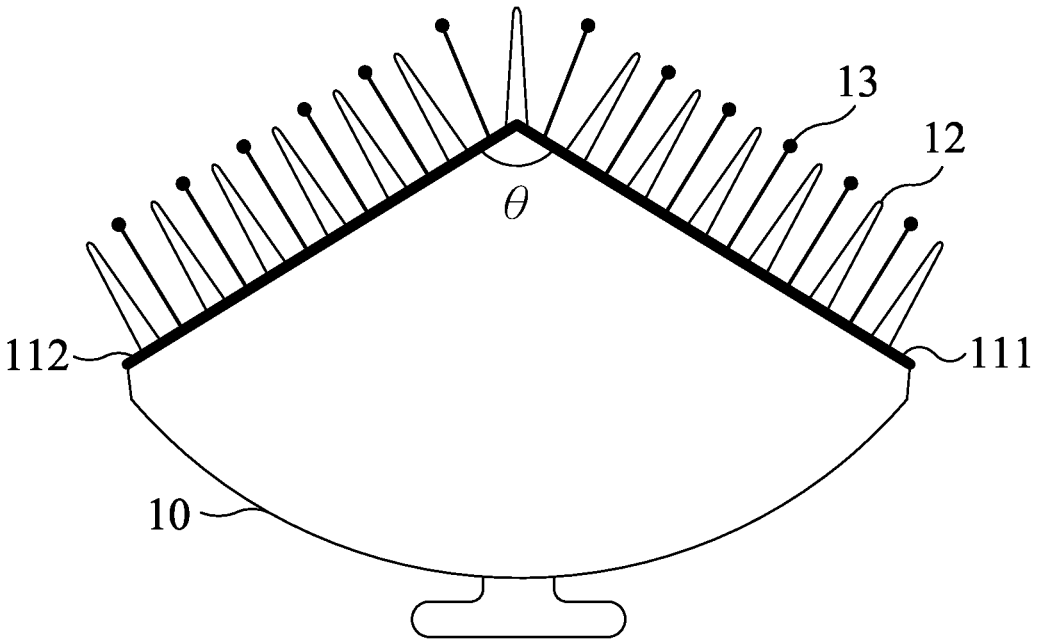

The sizes of the massage bristles and the detangling bristles, including lengths, shapes and diameters, etc., have a variety of combinations in order to be adapted for different volumes, lengths and features of hair. Generally, the massage bristles are thicker than the detangling bristles, and may be taller or shorter than or of a similar level to the detangling bristles depending on practical requirements. For example, when the detangling massage brush is used for detangling hair while messaging a user's scalp, it is preferred that the massage and detangling bristles cooperatively form a concave curve atop, as exemplified in FIG. 1B or 1C. On the other hand, if the detangling massage brush is used for detangling hair while messaging a pet's body, the flat distribution as shown in FIG. 1A is proper. Moreover, the massage and detangling bristles may cooperatively form a convex curve atop, as illustrated in FIG. 1D. The angle θ between the cross-sectional lines 111 and 112 is less than 180 degrees, which creates a smaller front end to enter the recess of the neck area between the pet's head and body, thereby detangling hair while messaging a pet's chin, neck and shoulder.

Figure 1E:
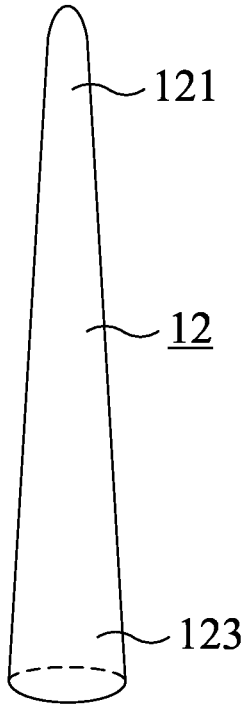
FIG. 1E is a schematic diagram illustrating an example of a massage bristle used in a massage brush according to an embodiment of the present invention.

The massage bristles may be cylinder-shaped, cone-shaped or any other suitable shape that facilitates massage effects. Taking a massage bristle as illustrated in FIG. 1E as an example, the lower portion 123 of the massage bristle 12 should be hard enough to stimulate the blood circulation system, and meanwhile, the upper portion 121 should be soft enough to avoid from hurting the user's skin. For achieving this purpose, the massage bristle 12 is made of, for example, a plastic or rubber material and is conic so that the upper portion 121 is inherently softer than the lower portion 123 due to smaller diameter. Alternatively, the upper portion 121 and the lower portion 123 may be made of different materials, which are integrally formed, for example, by injection molding.

Figure 2A:
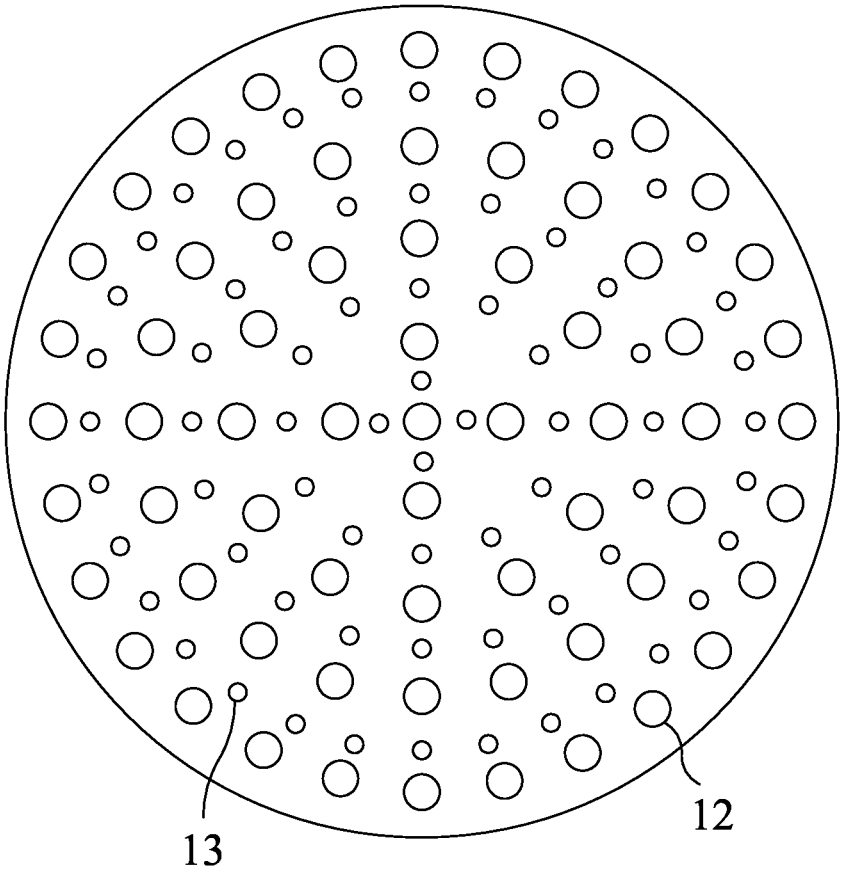
FIGS. 2A-2E are schematic top views illustrating allocating examples of massage bristles and detangling bristles of a massage brush according to an embodiment of the present invention.
Figure 2B:
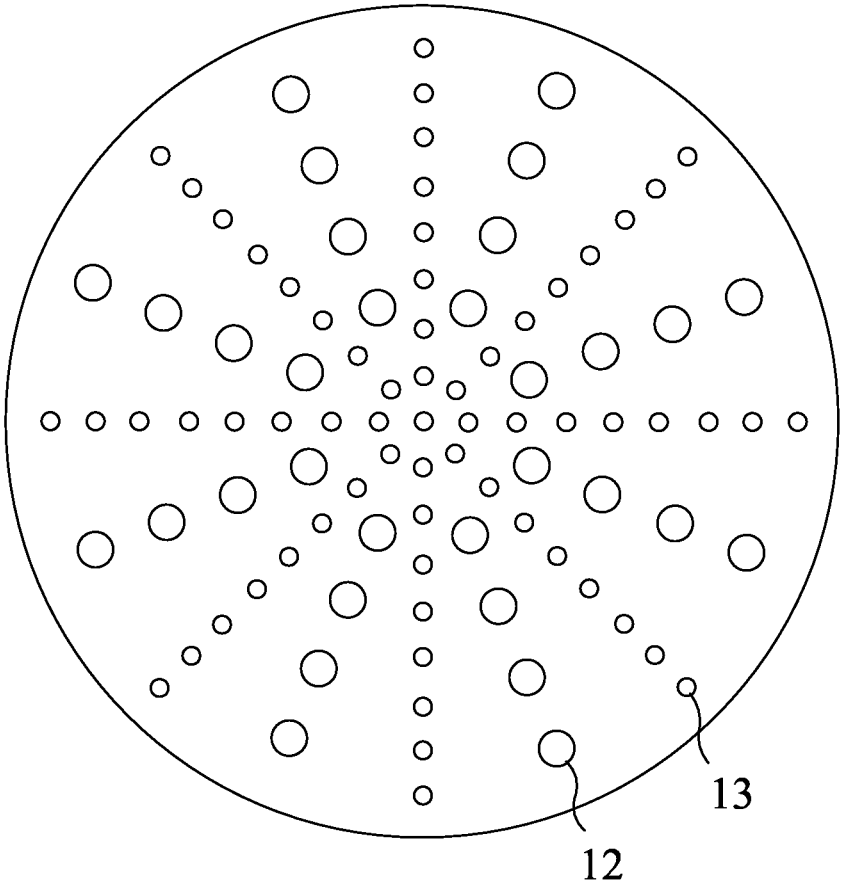
Figure 2C:
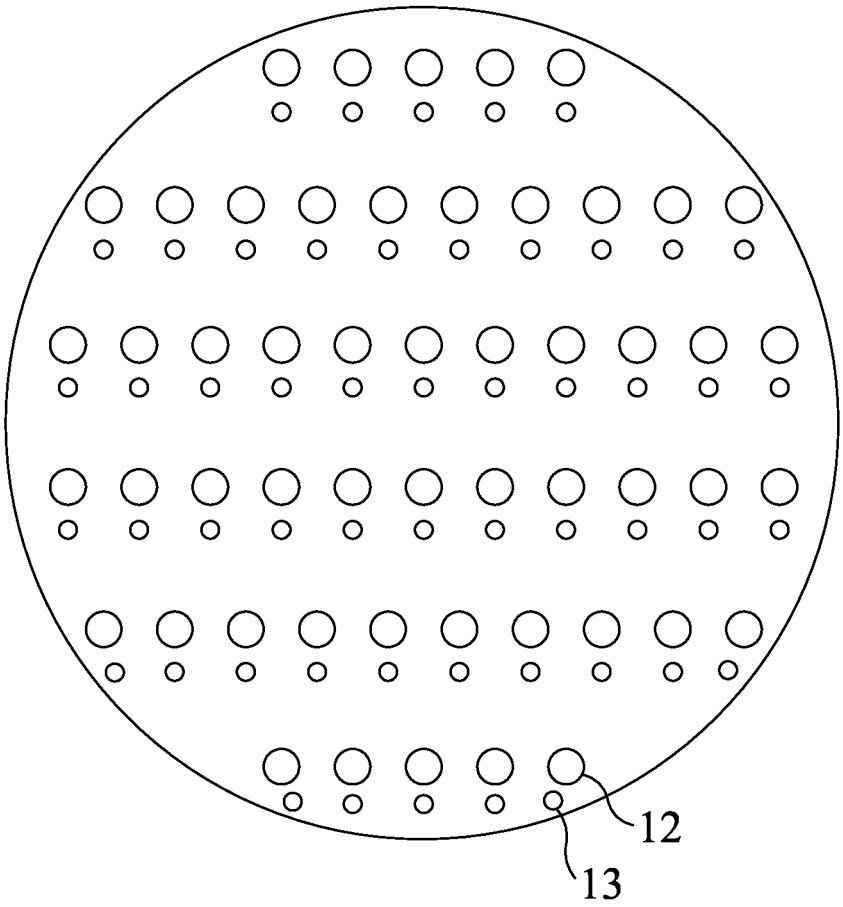
Figure 2D:
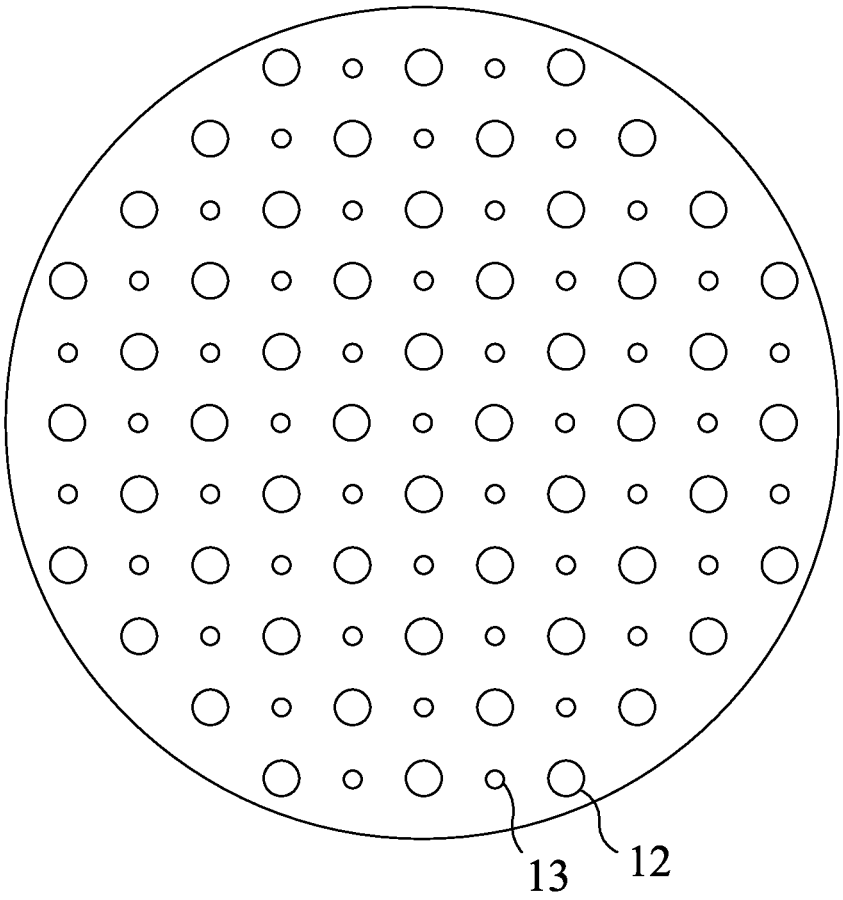
Figure 2E:
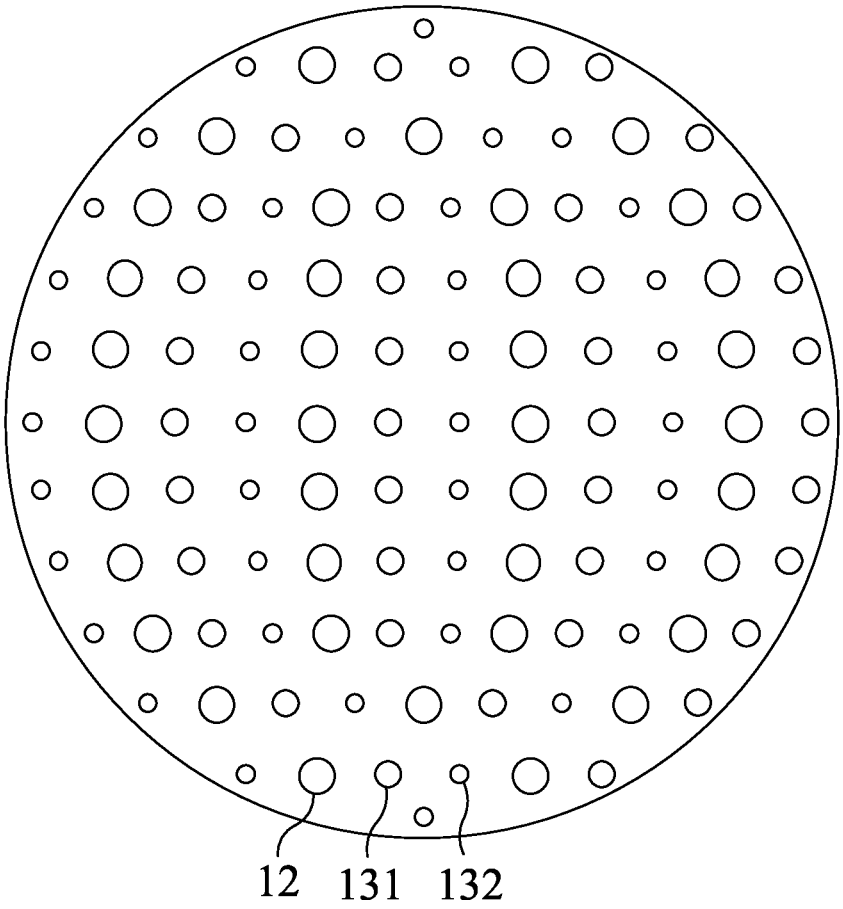

The detangling bristles may be thick ones for normal to thick hair, and thin ones for thin to normal hair. Basically, the detangling bristles are thinner than the massage bristles near the bristle base, and have optionally round heads. The diameter (or width) of a thick detangling bristle may be, for example, 0.8~1.8 mm, preferably 1~1.5 mm, and more preferably 1.3 mm. The diameter of a thin detangling bristle may be, for example, 0.4~1 mm, preferably 0.5~0.8 mm, and more preferably 0.7 mm. A detangling massage brush according to the present invention, when having taller detangling bristles than massage bristles, are suitable for thick hair; a detangling massage brush according to the present invention, when being of a similar level to massage bristles, are suitable for normal hair; and a detangling massage brush according to the present invention, when having shorter detangling bristles than massage bristles, are suitable for fine hair. It is also feasible to combine different sizes of detangling bristles with the massage bristles to produce a universal type of detangling massage brush. Different types of bristles may be mingled and randomly or evenly distributed, or allocated as specific patterns, as exemplified in FIGS. 2A-2E. The bristles illustrated in FIG. 2A include massage bristles 12 and detangling bristles 13 concentrically allocated. The bristles illustrated in FIG. 2B include massage bristles 12 and detangling bristles 13 radially allocated. The bristles illustrated in FIG. 2C include massage bristles 12 and detangling bristles 13 alternately allocated row by row, and in this embodiment, each massage bristle 12 is adjacently accompanied by a detangling bristle 13. The bristles illustrated in FIG. 2D include massage bristles 12 and detangling bristles 13 allocated as interleaving lattices. The bristles illustrated in FIG. 2E include massage bristles 12 and thick and thin detangling bristles 131 and 132 alternately allocated.

Figure 3:
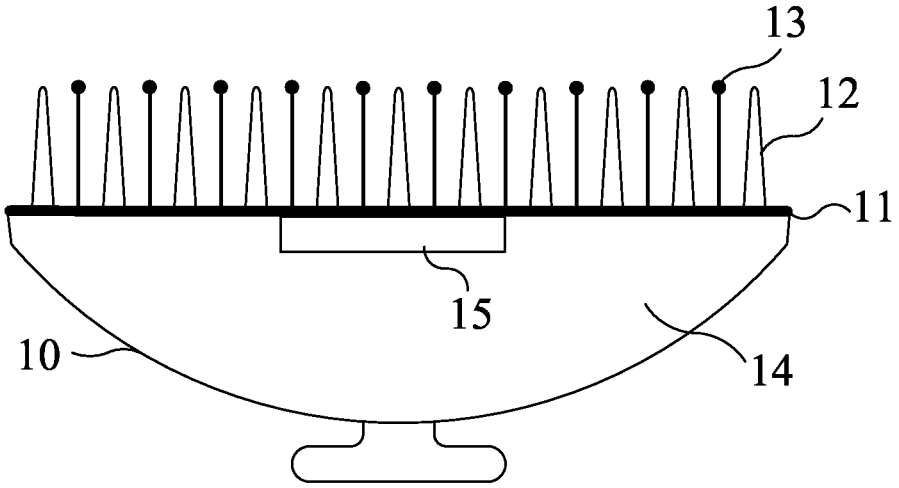
FIG. 3 is a schematic cross-sectional view of a massage brush according to another embodiment of the present invention.

For enhancing massage effects, the detangling massage brush may further include an auxiliary device 15, e.g. a vibrator and an associated power supply such as a battery, in a space 14 enclosed by the supporting base 11 and the brush body 10, as schematically illustrated in FIG. 3. It is understood that the auxiliary device 15 may be alternatively disposed at any other suitable position. In another embodiment, the auxiliary device 15 may be a massage oil reservoir, and the massage oil can be applied to scalp through the holes in the supporting base 11 or specific passages.

Figure 4A:
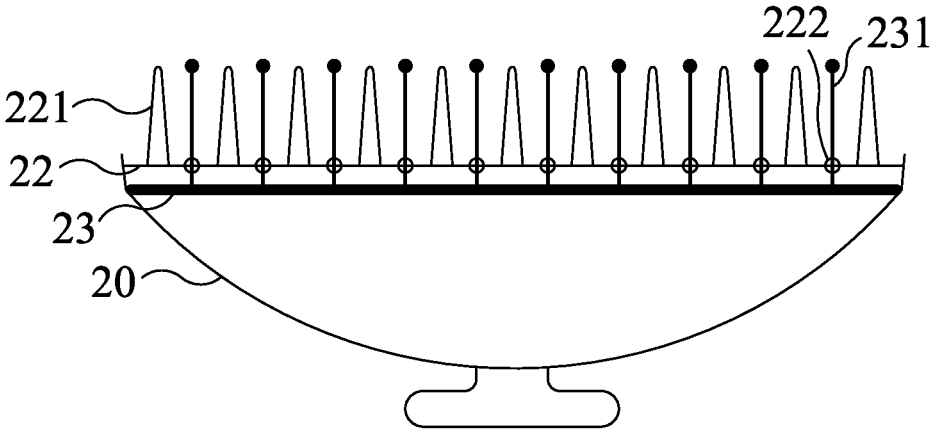
FIG. 4A is a schematic cross-sectional view of a massage brush according to a further embodiment of the present invention.

In the above embodiments, the massage bristles 12 and detangling bristles 13, 131 and 132 are integrally formed on the same supporting base 11, for example, by way of injection molding. Then the supporting base 11 formed with the bristles are assembled to the brush body 10 to produce the massage brush. Alternatively, the massage bristles and detangling bristles may be separately produced, for example, by way of individual injection-molding processes, and assembled to form the hybrid bristles, for example by way of overlaying each other. In an embodiment as illustrated in FIG. 4A, the detangling massage hair includes a brush body 20, a massage-functional base 22 formed with massage bristles 221 for massaging scalp, and a detangling-functional base 23 formed with detangling bristles 231 for detangling hair. The massage-functional base 22 overlays the detangling-functional base 23, and has a plurality of through holes 222 for the detangling bristles 231 of the detangling-functional base 23 to stick out of the massage-functional base 22 and mix with the massage bristles 221. Then the combined massage-functional base 22 and detangling-functional base 23 with respective bristles are assembled to the brush body 20.

Figure 4B:
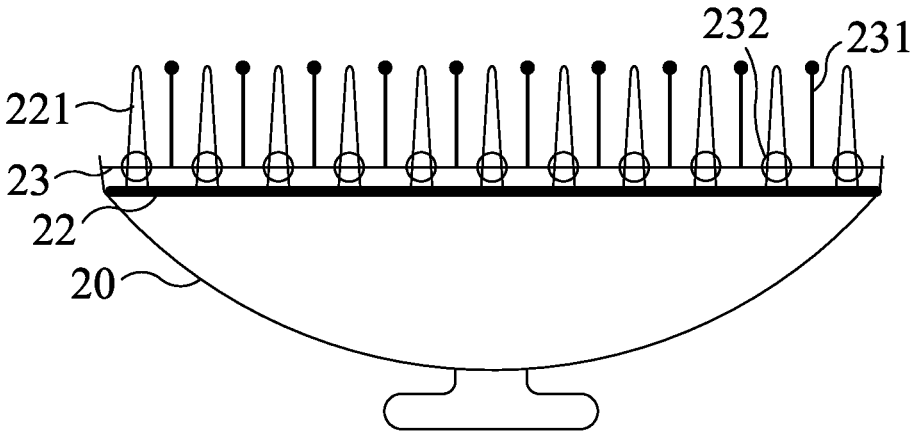
FIG. 4B is a schematic cross-sectional view of a massage brush according to still another embodiment of the present invention.

In an alternative embodiment as illustrated in FIG. 4B, the detangling-functional base 23 overlays the massage-functional base 22, and has a plurality of through holes 232 for the massage bristles 221 of the massage-functional base 22 to stick out of the detangling-functional base 23 and mix with the detangling bristles 231. Then the combined massage-functional base 22 and detangling-functional base 23 with respective bristles are assembled to the brush body 20.

Figure 5A:
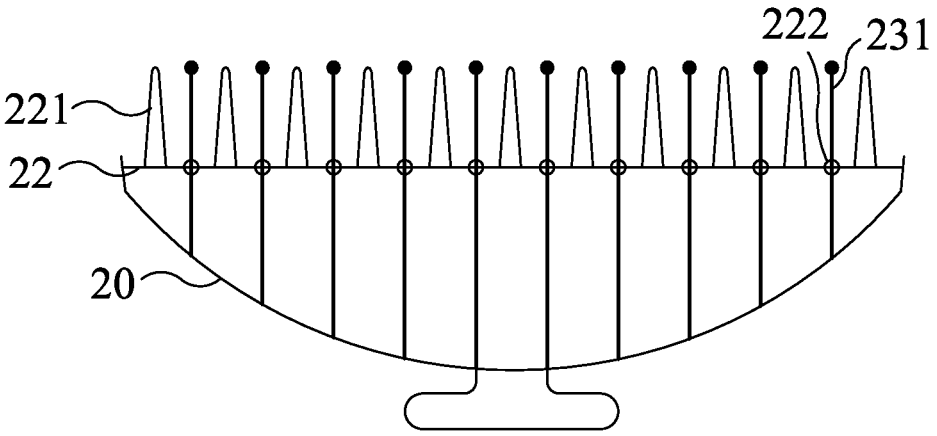
FIG. 5A is a schematic cross-sectional view of a massage brush according to a still further embodiment of the present invention.
Figure 5B:
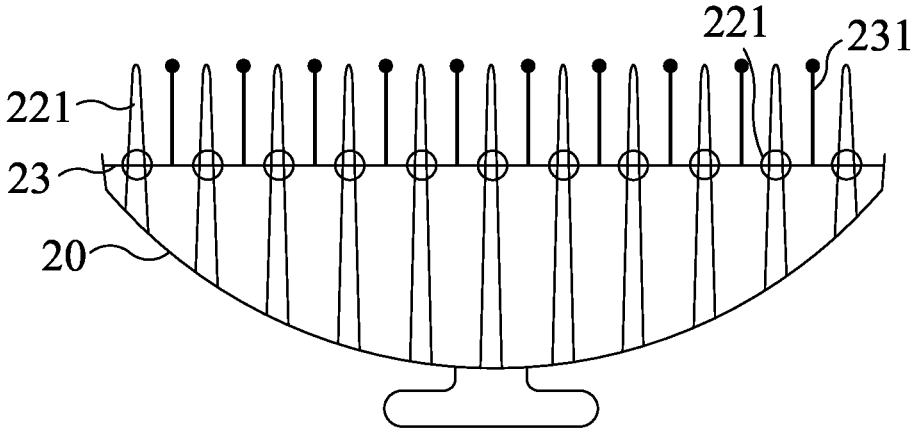
FIG. 5B is a schematic cross-sectional view of a massage brush according to a still further embodiment of the present invention.

In another embodiment, the detangling bristles 231 are integrated with the brush body 20, and then the detangling bristles 231 on the supporting base 21 penetrate through the massage-functional base 22 to accomplish the assembly of the detangling massage brush as shown in FIG. 5A. Of course, it is also possible to integrate the massage bristles 221 with the brush body 20, and then the massage bristles 221 on the brush body 20 penetrate through the detangling-functional base 23 to accomplish the assembly of the detangling massage brush, as schematically illustrated in FIG. 5B. In these embodiments, the massage-functional base 22 with the massage bristles shown in FIG. 5A or the detangling-functional base 23 with the detangling bristles shown in FIG. 5B may be an optional means, which is detachably assembled to the brush body when necessary.

The brush body 11 or 21 used in the above embodiments functions as a handle base to be held by a user and/or a cushion for releasing stress applied onto the scalp during the circular movements. The massage-functional base 22 may be integrally formed with the massage bristles 221 by way of injection molding. The detangling-functional base 23 may also be integrally formed with the detangling bristles 231 by way of injection molding. In an example, the massage bristles 221 are formed of, for example but not limited to, silicon which is soft enough for massage purpose, and the detangling bristles 231 are formed of, for example but not limited to, nylon which would not hurt hair and scalp but rigid enough to detangle hair.

Figure 6A:
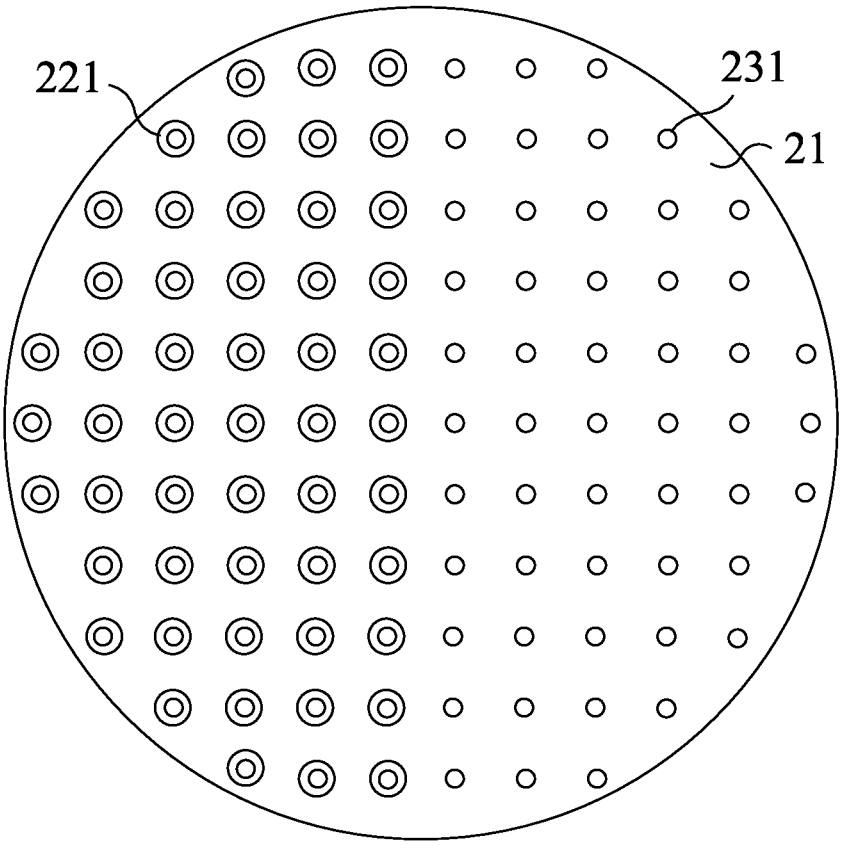
FIGS. 6A and 6B are schematic top and side views of a massage brush according to an embodiment of the present invention.
Figure 6B:
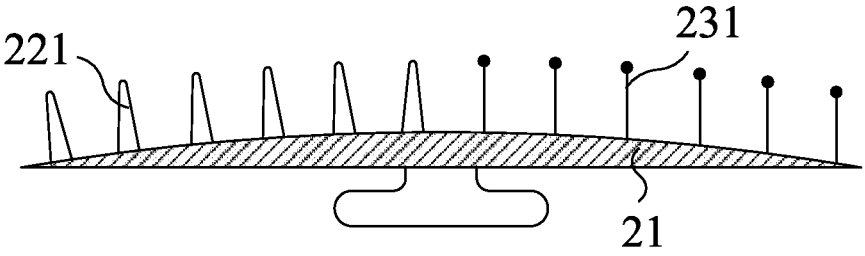

The sizes of the massage bristles and the detangling bristles, including lengths, shapes and diameters, etc., like the previously described embodiments, have a variety of combinations in order to be adapted for different volumes, lengths and features of hair. Similar discussion about the aspects, sizes, configurations, allocations and functions of the massage bristles and detangling bristles may be applied hereto, and would not be redundantly described FIG. 6A and FIG. 6B schematically illustrate a massage brush according to another embodiment of the present invention, wherein the massage bristles 221 and detangling bristles 231 are respectively grouped and allocated on a surface of the supporting base 11 at opposite sides, wherein FIG. 6A is a schematic top view and FIG. 6B is a schematic side view. This kind of massage detangling brush is advantageous in combining both massage and detangling functions in the same brush, while the two functions of the massage bristles 221 and detangling bristles 231 can be separately or sequentially executed. For example, for a long-hair user, massage bristles 221 work first and detangling bristles 231 work later; and for a short-hair user, a detangling operation may be omitted. Of course, the massage bristles 221 and detangling bristles 231 may simultaneously or alternately work together by turning the brush.

Figure 7:
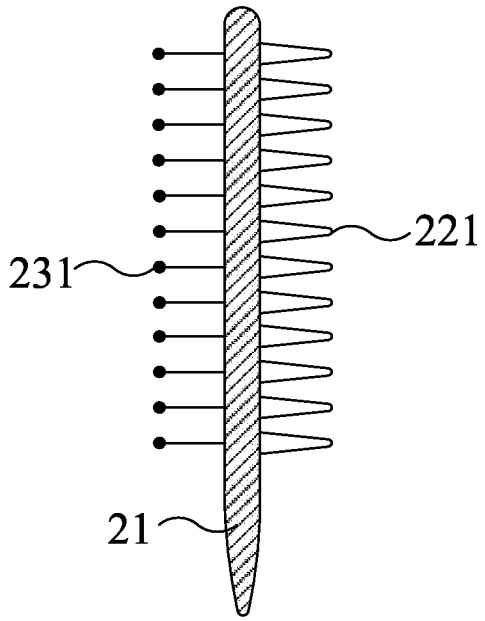
FIG. 7 is a schematic side view of a massage brush according to an embodiment of the present invention.

FIG. 7 is a schematic side view illustrating a detangling massage brush according to a further embodiment of the present invention, which is a paddle type of brush. The massage bristles 221 and detangling bristles 231 are disposed at opposite surfaces of the supporting base 21. In an embodiment, the massage bristles 221 and detangling bristles 231 are directly formed on the opposite surfaces of the supporting base 21. Alternatively, the massage bristles 221 and detangling bristles 231 may be formed on respective bases 22 and 23, and then assembled together.

Figure 8:
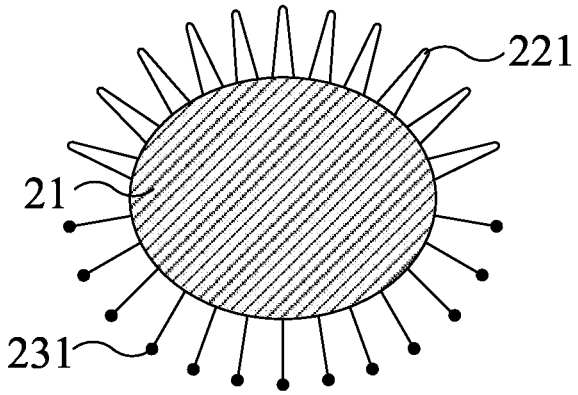
FIG. 8 is a schematic top view of a massage brush according to an embodiment of the present invention.

FIG. 8 is a schematic side view illustrating another example of massage detangling brush, which is a round or elliptical brush. Each of the massage bristles 221 and detangling bristles 231 occupies a portion of the circumference of the round brush, e.g. half and half. In a further example of detangling massage brush, the supporting base may be a triangular cylinder or other polygonal cylinder, which has at least two of the surfaces provided with massage bristles of the same or different sizes and detangling bristles of the same or different sizes, respectively.

Figure 9:
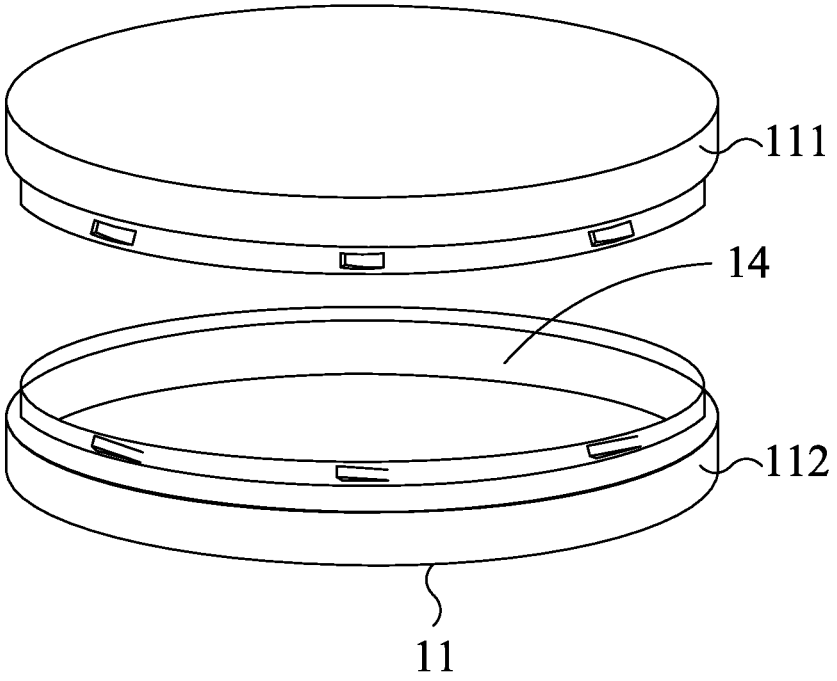
FIG. 9 is a schematic diagram illustrating an example of a supporting base included in a massage brush according to the present invention.

In the embodiments described with reference to FIG. 3, the auxiliary device 15 is disposed on a surface of the supporting base 11. Alternatively, the supporting base 11 may be made hollow, and an additional device (not shown) such as the auxiliary device 15 may be disposed inside the supporting base 11. For example, the supporting base 11 consists of two portions 111 and 112, which can be engaged with and disengaged from each other and define the space 14 therein for receiving the additional device. One example of the engaging and disengaging means is hook and slot, as schematically illustrated in FIG. 9, in which bristles are omitted from showing. Other examples of the engaging and disengaging means, e.g. screw and threads, may also be used.

Figure 10:
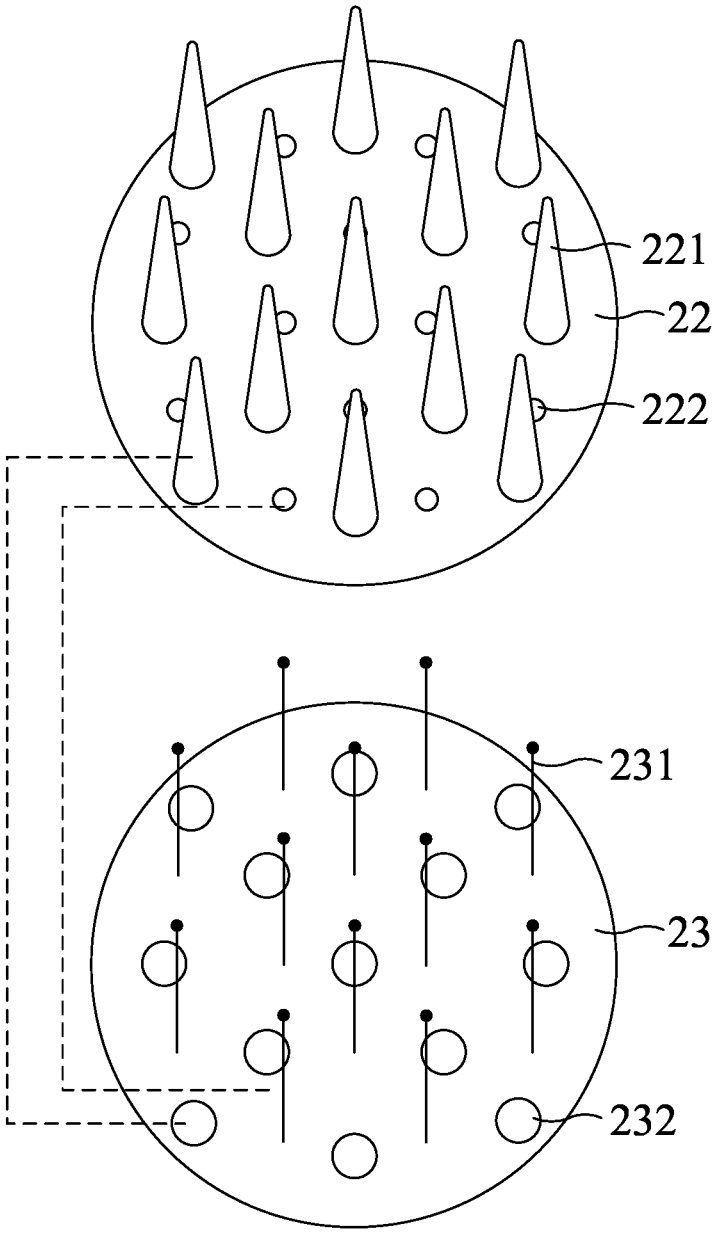
FIGS. 10, 11 and 12 are schematic diagrams illustrating replaceable accessories included in a detangling brush kit according to the present invention.
Figure 11:
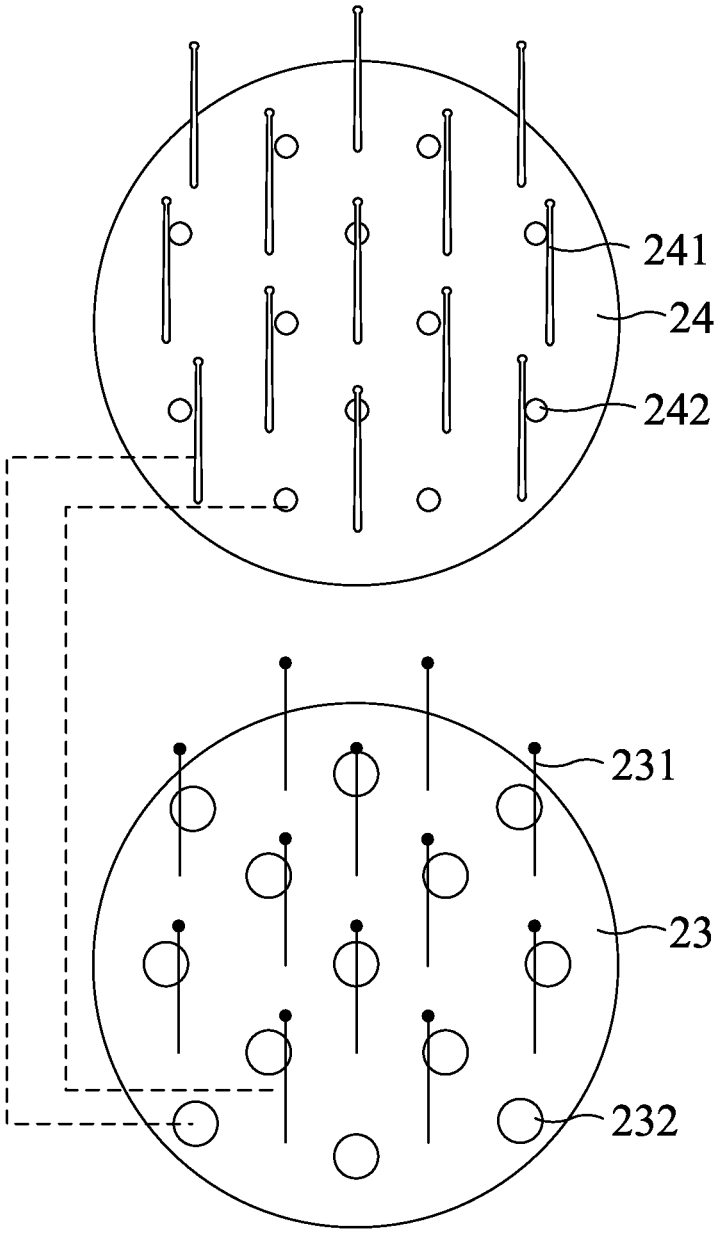
Figure 12:
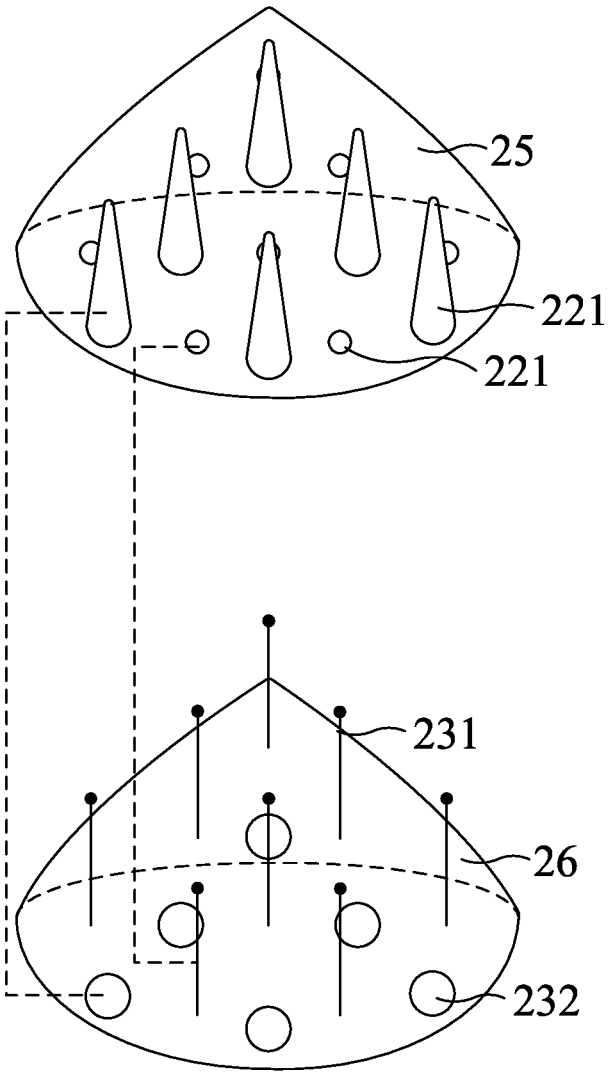

For further enhancing the applications of the detangling massage brush of the present invention, a detangling brush kit is provided. The detangling brush kit includes a brush body and a plurality of bristle accessories selectable to be mounted to the brush body according to practical requirements. For example, the detangling brush kit includes a default brush as shown in FIG. 1A, and one or more bristle accessories selected from the bristle bases 11 with bristles 12 and 13 as shown in FIGS. 1B, 1C, 1D, 3 and 6A, as well as the bristle bases 22, 23, 24, 25 and 26 with respective bristles 221, 231, 241, 251 and/or 261, as shown in FIGS. 10, 11 and 12. Each of the bristle bases has a size and shape in complying with the opening of the brush body 20, and is mounted to the brush body 20 in a detachable manner. Referring to FIG. 10, the bristle base 22 include a plurality of massage bristles 221 and a plurality of holes 222, and the bristle base 23 include a plurality of detangling bristles 231 and a plurality of holes 232. In this embodiment, the positions of the holes 222 are aligned with the positions of the detangling bristles 231, and meanwhile, the positions of the holes 232 are aligned with the positions of the massage bristles 221. Accordingly, the massage bristles 221 may be independently used, or they may be used together with the detangling bristles 231 by inserting the detangling bristles 231 through the holes 222 or inserting the massage bristles 221 through the holes 232. The detangling brush kit may further include a bristle base 24 with hair-smoothing bristles 241 and holes 242, as shown in FIG. 11. Likewise, the hair-smoothing bristles 241 may be independently used, or they may be used together with the detangling bristles 231 by inserting the detangling bristles 231 through the holes 242 or inserting the hair-smoothing bristles 241 through the holes 232. In further embodiments, different contours of bristle bases with bristles, as illustrated in FIG. 12, may also be included in the detangling brush kit for selection or combination as long as they are able to fit the brush body 20.

From the above descriptions, it is clear that the functions of a massage brush can be enhanced by providing additional detangling bristles. The features of the detangling bristles, such as quantity, size and distribution, may be designed depending on the features of the massage bristles, and the functions to be achieved by the brush.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A massage brush, comprising:

a bristle base;

a plurality of massage bristles formed on the bristle base for massaging scalp, wherein for each of the massage bristles, an upper portion away from the bristle base is softer than a lower portion close to the bristler base; and a plurality of detangling bristles formed on the bristle base for detangling hair;

wherein the detangling bristles are thinner than the massage bristles at the bristle base, and having a diameter ranged between 0.4 mm and 1.8 mm, and wherein the bristle base includes a massage-functional base formed with the massage bristles and a detangling-functional base formed with the detangling bristles, and the detangling bristles penetrate through holes of the massage-functional base or the massage bristles penetrate through holes of the detangling-functional base so that the massage-functional base and the detangling-functional base overlap with each other, and the massage bristles and the detangling bristles are mingled with one another.

2. A massage brush, comprising:

a bristle base;

a plurality of massage bristles formed on the bristle base for massaging scalp, wherein for each of the massage bristles, an upper portion away from the bristle base is softer than a lower portion close to the bristler base; and a plurality of detangling bristles formed on the bristle base for detangling hair;

wherein the detangling bristles are thinner than the massage bristles at the bristle base, and having a diameter ranged between 0.4 mm and 1.8 mm, and wherein the bristle base includes a brush body to be held with a user's hand, where one of the massage bristles and the detangling bristles are formed, and a supporting base, where the other of the massage bristles and the detangling bristles are formed, and the supporting base has holes and is assembled to the brush body to have both the massage bristles and the detangling bristles stick outwards and mingled with one another.

3. A massage brush, comprising:

a bristle base;

a plurality of massage bristles formed on the bristle base for massaging scalp, wherein for each of the massage bristles, an upper portion away from the bristle base is softer than a lower portion close to the bristler base;

a plurality of detangling bristles formed on the bristle base for detangling hair; and an auxiliary device, wherein the bristle base is a hollow supporting base having an accommodation space for accommodating the auxiliary device, wherein the detangling bristles are thinner than the massage bristles at the bristle base, and having a diameter ranged between 0.4 mm and 1.8 mm.

4. A massage brush, comprising:

a bristle base including a massage-functional base and a detangling-functional base;

a plurality of massage bristles formed on the massage-functional base for massaging scalp; and a plurality of detangling bristles thinner than the massage bristles and formed on the detangling-functional base for detangling hair;

wherein the detangling bristles penetrate through holes of the massage-functional base, or the massage bristles penetrate through holes of the detangling-functional base, so that the massage-functional base and the detangling-functional base overlap with each other, and the massage bristles and the detangling bristles stick out of a same surface of the bristle base and are mingled with one another.

5. The massage brush according to claim 4, wherein the detangling bristles are thinner than the massage bristles at the bristle base, and having a diameter ranged between 0.8 mm and 1.8 mm.

6. The massage brush according to claim 4, wherein the detangling bristles are thinner than the massage bristles, and having a diameter ranged between 0.4 mm and 1 mm.

7. The massage brush according to claim 4, wherein the detangling bristles are thinner than the massage bristles, and include a first group of detangling bristles having a diameter ranged between 0.8 mm and 1.8 mm, and a second group of detangling bristles having a diameter ranged between 0.4 mm and 1 mm.

8. The massage brush according to claim 4, further comprising a brush body to be held with a user's hand, which defines an accommodation space together with the bristle base, and an auxiliary device installed in the accommodation space.

9. The massage brush according to claim 8, wherein the auxiliary device includes a vibrator and an associated power supply.

10. The massage brush according to claim 8, wherein the auxiliary device includes a massage oil reservoir.

11. The massage brush according to claim 4, wherein the plurality of massage bristles and the plurality of detangling bristles are distributed in different regions of the bristle base.

* * * * *